United States Patent [19]

Wallace

[11] Patent Number: 4,974,348

[45] Date of Patent: Dec. 4, 1990

[54] CHAIN DIGGER ATTACHMENT

[76] Inventor: Peter J. Wallace, 46 Celandine Street, Shailer Park, Queensland, 4128, Australia

[21] Appl. No.: 423,403

[22] PCT Filed: Feb. 8, 1988

[86] PCT No.: PCT/AU88/00034

§ 371 Date: Aug. 4, 1989

§ 102(e) Date: Aug. 4, 1989

[87] PCT Pub. No.: WO88/05848

PCT Pub. Date: Aug. 11, 1988

[30] Foreign Application Priority Data

Feb. 8, 1987 [AU] Australia ..... 68649/87

[51] Int. Cl.[5] ..... E02F 5/06

[52] U.S. Cl. ..... 37/87; 37/86; 37/191 A

[58] Field of Search ..... 37/191 A, 192 A, 80 R, 37/87, 90; 32/86

[56] References Cited

U.S. PATENT DOCUMENTS

| | | | |
|---|---|---|---|
| 3,266,179 | 8/1966 | Golden . | |
| 3,834,049 | 9/1974 | Bond . | |
| 3,991,494 | 11/1976 | Schuermann et al. . | |
| 4,483,084 | 11/1984 | Caldwell et al. . | |
| 4,861,199 | 8/1989 | Hackmack | 37/191 A X |

FOREIGN PATENT DOCUMENTS

| | | |
|---|---|---|
| 67204/65 | 11/1965 | Australia . |
| 2515193 | 10/1976 | Fed. Rep. of Germany . |
| 1355435 | 8/1971 | United Kingdom . |

*Primary Examiner*—Dennis L. Taylor
*Assistant Examiner*—J. Russell McBee
*Attorney, Agent, or Firm*—Foley & Lardner, Schwartz, Jeffery, Schwaab, Mack, Blumenthal & Evans

[57] ABSTRACT

A chain digger attachment (10) for boom (11) mounted operation with disconnectable couplings (13, 66, 67), the attachment having a chain (17, 60) extended about sprockets (19,23,61,83) on a telescopic support frame(14,64,65) having sideways feeding discharging augers (27,28,81,82), clearing ploughs (72) and elongate chain guard (73) along the return reach of the chain (60).

7 Claims, 7 Drawing Sheets

FIG 1
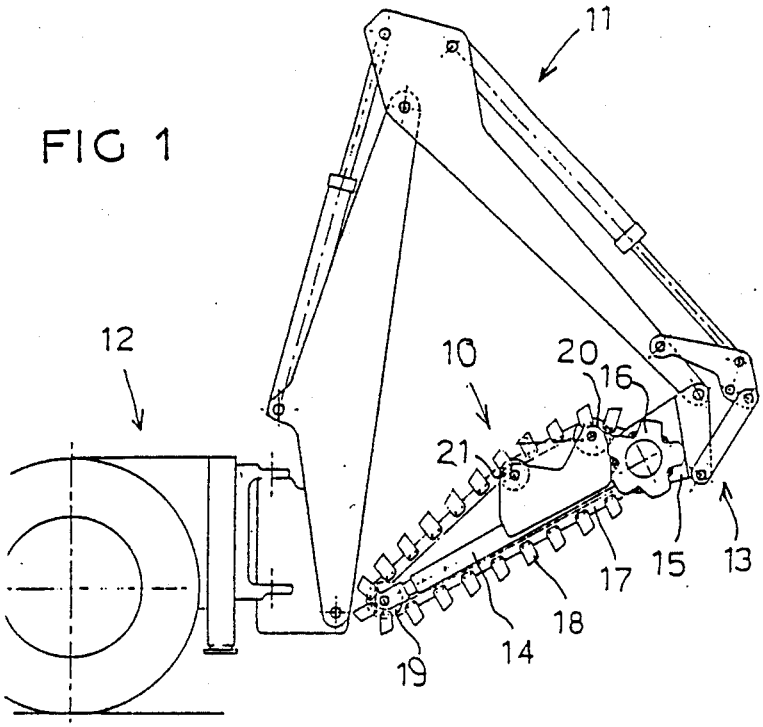
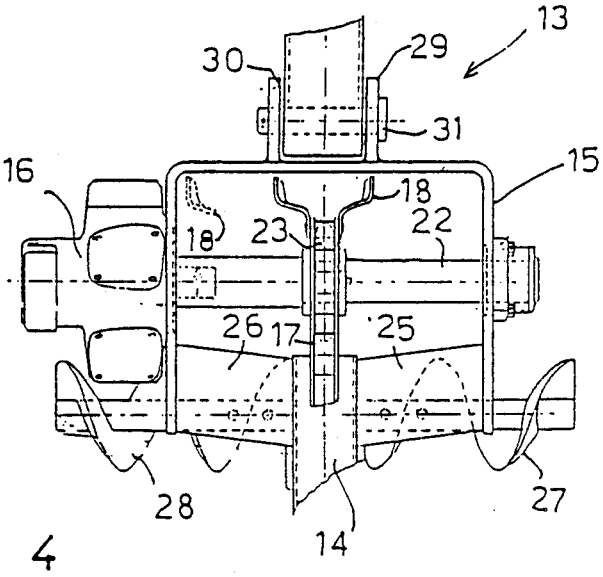
FIG 4

FIG 3
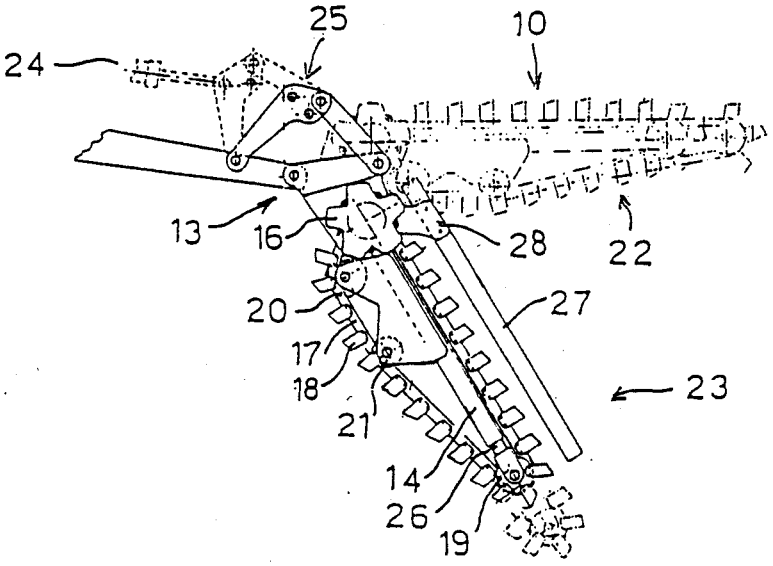
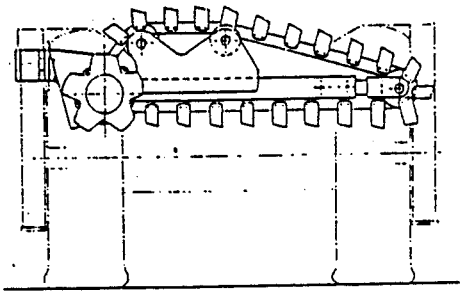
FIG 2

FIG 10
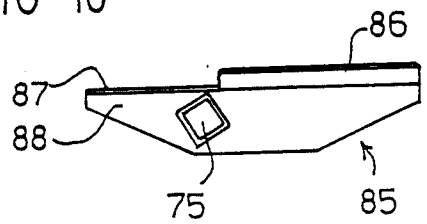
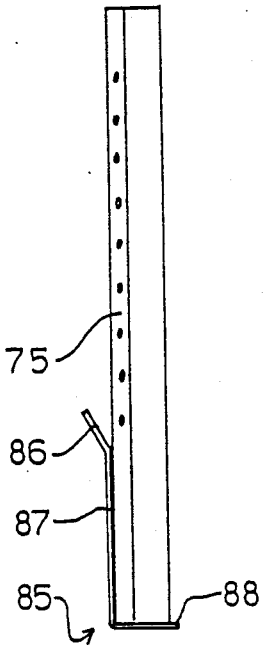
FIG 11
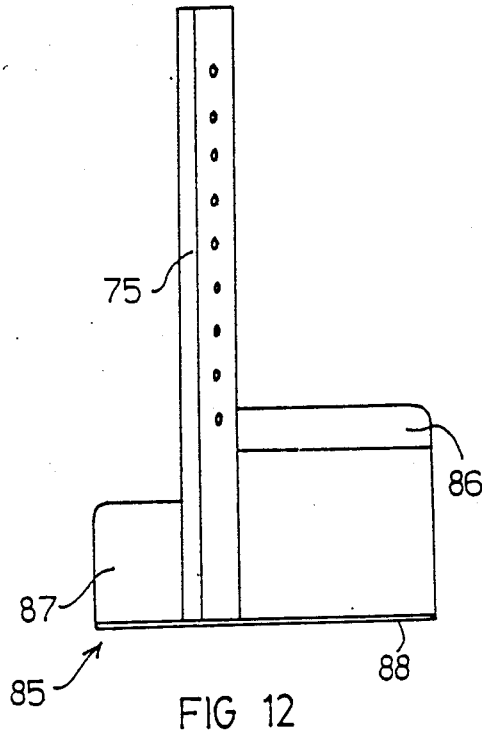
FIG 12

CHAIN DIGGER ATTACHMENT

FIELD OF THE INVENTION

This invention relates to an attachment that may be mounted on the boom of earthworking apparatus, in particular to a chain digger attachment.

BACKGROUND OF THE INVENTION

Booms are commonly mounted off tractors and special purpose vehicles by which hoes, and other attachments, may be supported for earthworking operations. The now common back hoe is one such piece of equipment on which a variety of work heads may be interchanged so as to increase the versatility of the apparatus.

It is an object of the present invention to further develop the versatility of equipment of the type set out above by provision of a workhead that performs the functions of a chain digger. Other objects, and various advantages, of the present invention will hereinafter become apparent.

STATEMENT OF THE INVENTION

The invention achieves its object by provision of a chain digger attachment for a boom mounted operation characterised in that there is provided:

a support frame for passage of a digging chain thereabout, the chain being passed over guide means therefor mounted on the support frame;

a disconnectable coupling means on the support frame whereby the support frame may be coupled to an articulated boom;

a source of motive power mounted on the frame and drivingly connected to one of the guide means, the source of motive power being activated by a pressurised fluid;

coupling lines for pressurised fluid to the source of motive power and provided with disconnectable connection means whereby the lines to the power source may be broken to enable dismounting of the attachment, and at least one ground engaging projection mounted on the support frame and providing a footing against which the boom may be actioned to push the support vehicle forward of a trench being formed by the attachment.

DESCRIPTION OF THE DRAWINGS

The invention will now be described with reference to a preferred embodiment as shown in the accompanying drawings wherein:

FIG. 1 is a side elevation of the rear end of a back hoe boom with a chain digger attachment in accordance with the present invention;

FIG. 2 shows how the attachment of FIG. 1 may be tucked in across the rear of the support vehicle;

FIG. 3 shows the attachment of FIGS. 1 and 2 in various dispositions;

FIG. 4 is a detailed view of the mounting end of the attachment;

FIGS. 10, 11 and 12 are plan, side and elevations respectively of a plan means for use in the device of FIGS. 8 and 9.

DESCRIPTION OF PREFERRED EMBODIMENTS

Figure 5:
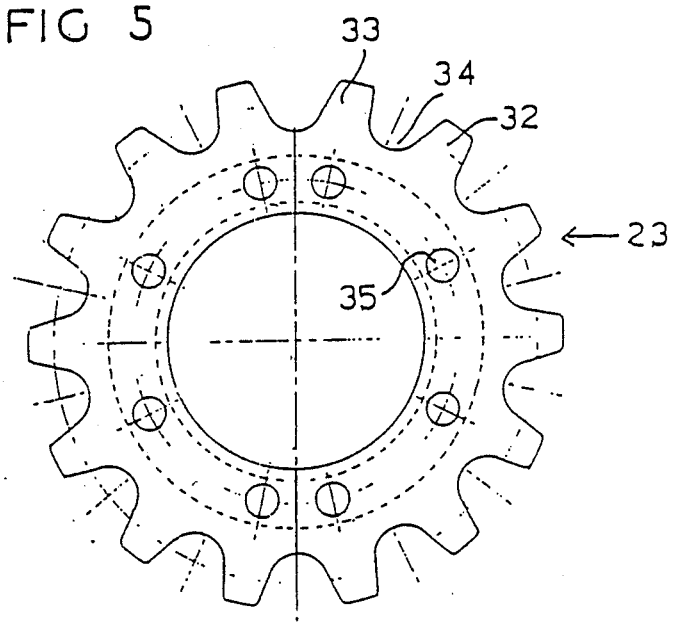
FIGS. 5 and 6 show a drive sprocket and hub therefor.

In FIG. 1, a chain digger attachment 10 is mounted to a back hoe style boom 11 at the rear 12 of a support vehicle, not shown. The chain digger attachment is disconnectably coupled at 13 to boom 11. The chain digger attachment is built upon a support frame 14 having disconnectable coupling at end 15 to which a motor 16 is mounted with a driving sprocket (not shown) engaged with chain 17 having digging means such as 18 attached thereto. The digging chain 17 is passed around sprockets 19, 20 and 21 which are supported upon the support frame 14.

In FIG. 3, the chain digger attachment is shown in two positions, an extended position 22 (shown in phantom form) and a trenching position 23. A ram 24 controls the angle of the attachment 10 through linkages at 25. In trenching, material brought to the surface is spread sideways by action of an auger on the axis of, and driven by, sprocket 20 (see FIG. 4). The motor 16 may be hydraulic and can be supplied by lines that are disconnectably connected thereto. The sprocket 19 may be mounted upon an extensible end 16 of support frame 14 to enable lengthening of the support frame to enable tensioning of the digger chain. A guard bar 27 is mounted at 28 to the coupling end of frame 14.

In FIG. 4 support frame 14 is joined to a yoke 15 on support arms 25 and 26 therebetween. The sprocket 20 (not seen in this view, being beneath the support frame 14) drives two sideways projected auger elements 27 and 28 which may be keyed, splined, bolted etc. to the axle of sprocket 20. The width of the yoke 15 is such that the digging elements 18 of the chain 17 may pass therethrough. Motor 16 is drivingly connected to a drive shaft 22 which carries drive sprocket 23 to drive the chain. The yoke 15 is connected to the boom by brackets such as 29 and 30 with pin 31 therethrough.

Figure 6:
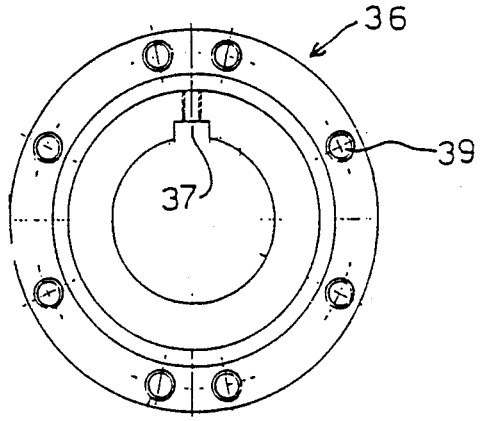

Drive sprocket 23 as seen in FIG. 5 may be comprised of two parts 32 and 33 which abut along line 34 so that the sprocket may be split for mounting and dismounting off a drive shaft. Should a replacement be required to be fitted to the chain digger attachment, the chain need only be slackened off, bolts in holes 35 that hold the sprocket to a hub as shown this figure undone, and the two halves may be lifted away and a new sprocket pair put in place by reversing the operation. FIG. 6 shows a drive hub 36 which may be mounted on drive shaft 22 (of FIG. 4) and keyed thereto at 37, with a corresponding pattern of threaded holes 39 for receipt of bolts to lock the drive gear halves thereto.

Figure 7:
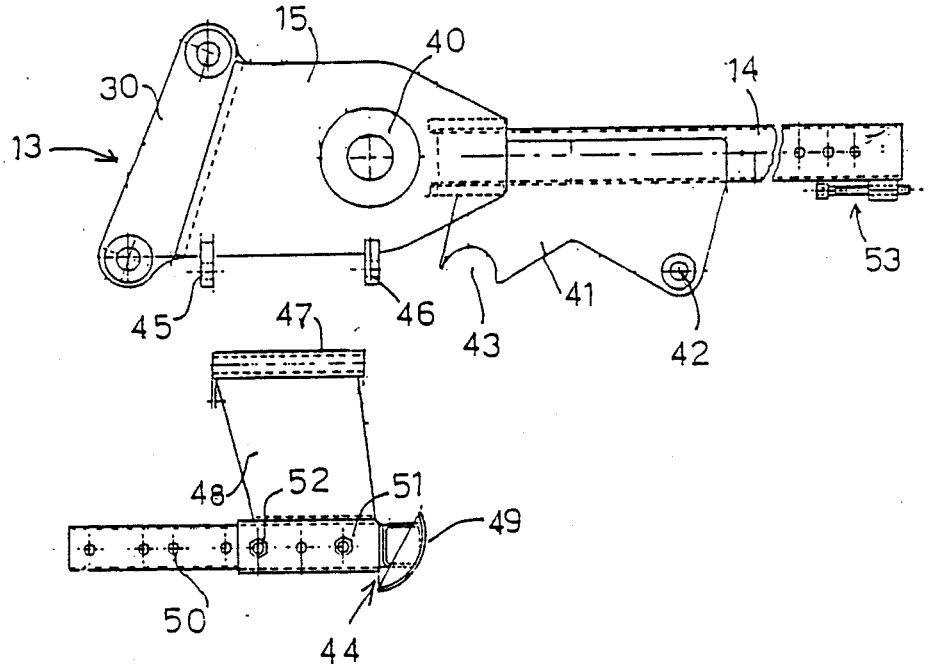
FIG. 7 shows how a pusher foot may be mounted to the attachment of FIGS. 1 and 2.

FIG. 7 shows a detailed view of the support frame 14, yoke 15 and a pusher foot 44 that may be mounted to the yoke. Drive shaft 22 is mounted in yoke 15 through hole 40 and sprockets 20 and 21 are mounted at points 43 and 42. The attachment is coupled at 13 to a boom by pins through brackets 30 and 29 (not in view). Yoke 15 carries two brackets 45 and 46 between which support 47 is placed with a connector such as a shaft passed through all three to lock pusher foot 44 to yoke 15. Pusher foot 44 comprises an arm 49 which extends to both sides of the boom (perpendicular to the plane of the drawing). Arm 49 is mounted on rod 50 which is bolted at 51 and 52 within a slide means on plate 48 to hold the arm 49 in fixed relation to the attachment. In use, the pusher foot may be used as a stop against which the boom may thrust to push the support vehicle forward as the trench progresses in steps.

In FIG. 3, the end sprocket 19 is mounted telescopically at 26 on the end of support frame 14. So as to enable dismantling, the sprocket is allowed to telescope inwardly and, as seen in FIG. 7, support frame 14 may carry a threaded means 53 by which an outward thrust may be applied to the sprocket to tension it, and bolt holes may be provided to enable it to be fixed in place. Where the length of the chain digger attachment is greater than the vehicle width so that its ends project beyond the vehicle sides when in the position of FIG. 2, the length might be shortened by collapsing the sprocket 19 inwardly. To enable an easy adjustable operation, a ram may be fitted between the support frame 14 and the sprocket mount so as to move it in either of the telescopic directions.

Figure 8:
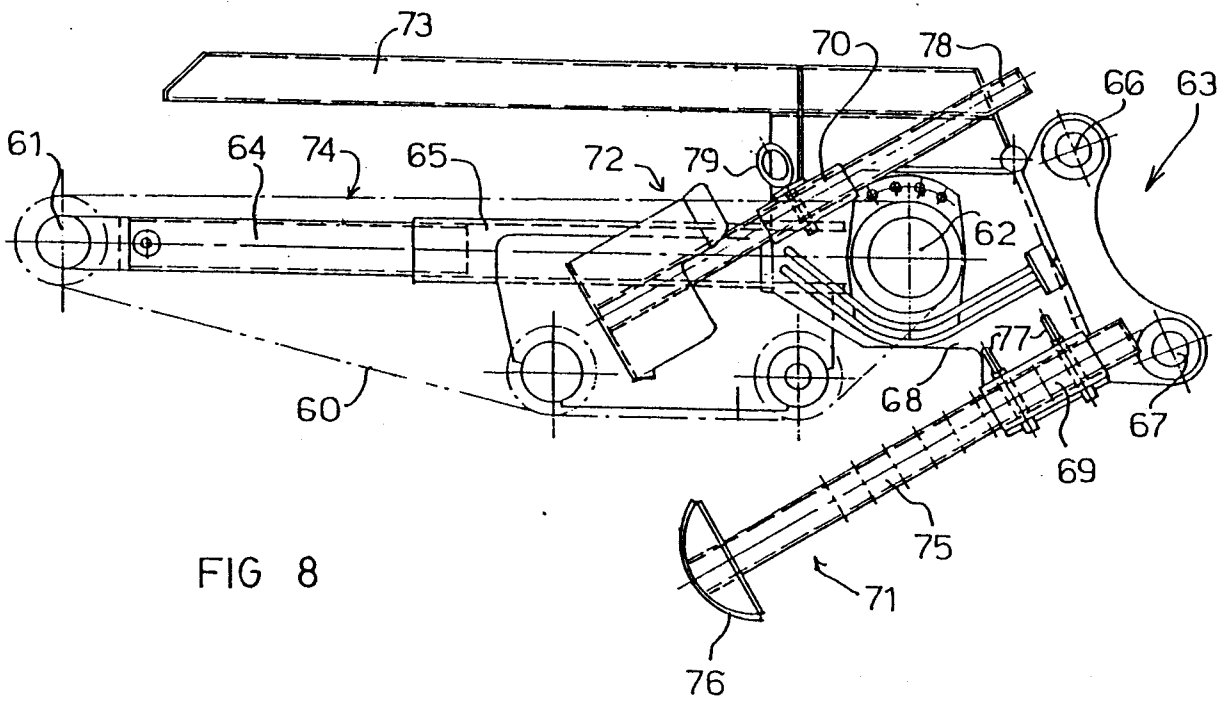
FIGS. 8 and 9 are respectively elevation and plan views of a alternate form of attachment in accordance with the inVention.
Figure 9:
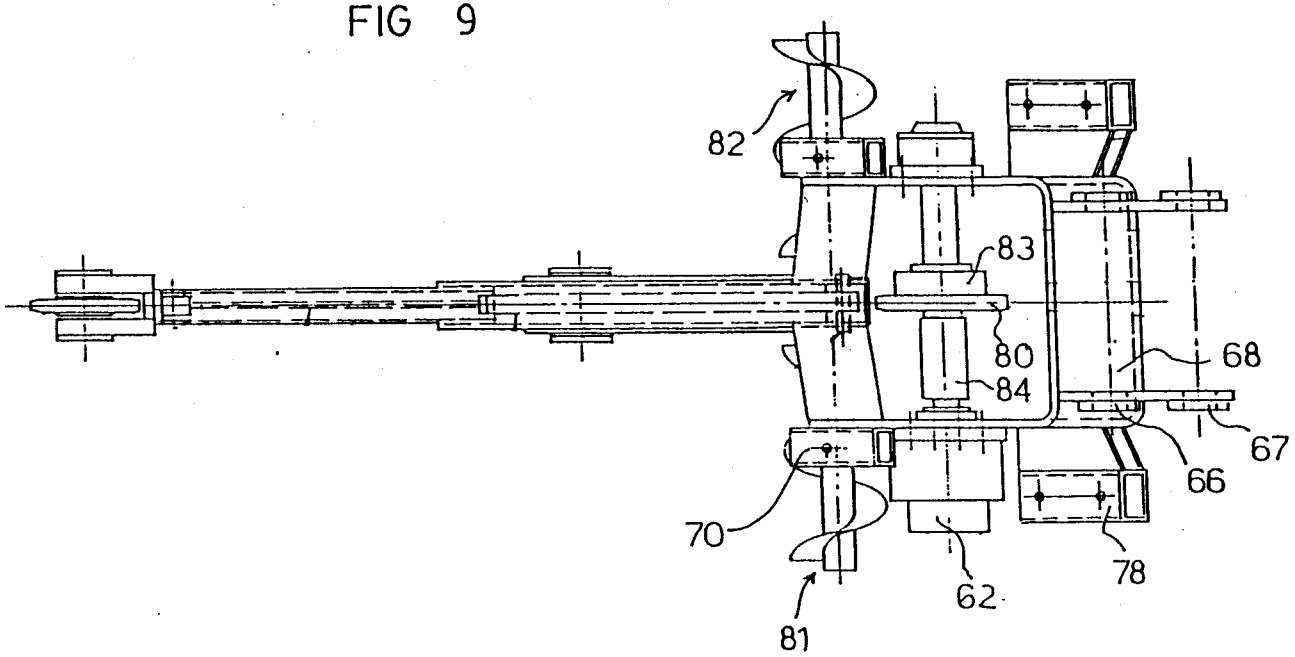

In FIGS. 8 and 9 is shown a more developed chain digger attachment wherein a chain 60 (indicated only generally by a line indicating its various reaches) is passed around a pair of spaced sprockets. Sprocket 61 is at the extreme end of the digger and a driving sprocket 80 is at the coupling end 63 driven by motor 62. The length of the attachment is variable between the spaced apart chain sprockets with a forward support arm 64 being telescopically slidable within support frame arm 65 which may contain an internal ram whereby the length of the attachment may be varied. By this means, the attachment may be shortened during nontrenching travel of its, supporting vehicle, and the shortening is also useful when the chain needs to be slackened during servicing of the attachment.

The attachment of FIG. 8 is coupled to a boom or other mounting point on a support vehicle by use of standard means such as pins in coupling points 66 and 67 which are attached to a yoke 68 that supports the mechanisms of the attachment. Externally of yoke 68, on each side thereof may be provided mounting means 69 and 70. In mounting means 69 is provided a pusher foot 71. In mounting means 70 is provided plow 72. Also mounted on the attachment is a guard 73 which comprises an arm that extends parallel (as shown) to the return reach 74 of the chain 60. The pusher foot may comprise a shaft 75 with a foot 76 thereon. Shaft 75 may be slidably fitted to mounting means 69 and locked thereto by pins 77. The shaft 75 and means 69 may be square sectioned stock with shaft 75 holed therealong such that its position may be varied. Pins 77 may be screwthreaded so as to be removably locked in place. Similarly, plow 72 may be adjustably held on stem 78 in means 70 by pins 79. The plow's construction is described below in greater detail. The plows and pusher feet are omitted from FIG. 9 for clarity.

In FIG. 9, augers 81 and 82 push material that is raised by the chain sideways away from the trench. Sprocket 80 may be of the type described above which is split and attached to a hub 83 on shaft 84 driven by motor 62 to be removable without the need for extensive dismantling of the machine.

FIGS. 10 and 12 show details of plow 72 of FIG. 9. A blade 85 is mounted to stem 75 which may be square section steel stock, holed regularly therealong for selective entry therein of a locking pin. Blade 85 may be formed from plate material with three separate planes by folding with a bevel 86 to main surface 87 that is terminated in an orthogonal third surface 88.

While the above has been described with reference to a preferred embodiment, it will be clear that many modifications may be made thereto that will be apparent to persons skilled in the art and these are within the scope and ambit of the invention.

I claim:

1. A chain digger attachment for a boom mounted operation comprising:

a support frame;

a disconnectable coupling means on said frame for operatively connecting said frame to an articulated boom on a movable support vehicle;

guide means mounted on said frame, and a digging chain passing over and engaging said guide means for movement thereby;

a source of motive power mounted on said frame and drivingly connected to one of said guide means for rotating said guide means and said digging chain;

a source of pressurized fluid for operating said source of motive power, and coupling lines connected to said source of pressurized fluid and provided with disconnectable connection means for disconnecting fluid pressure to said source of motive power to enable dismounting of said attachment; and at least one ground engaging projection mounted on said support frame comprising a pusher foot through which the boom engages the ground, said foot permitting said support vehicle to be pushed forwardly of a trench being formed by the attachment while the operator remains in a position to operate said digging chain.

2. A chain digger attachment as claimed in claim 1, wherein said guide means are held at spaced positions by an elongate support frame, and means for adjusting said elongate support means to vary the spacing.

3. A chain digger attachment as claimed in claim 1, wherein a pusher foot is provided on each side of the support frame adjacent the disconnectable coupling means.

4. A chain digger attachment as claimed in claim 1, wherein a pusher foot is provided on each side of the attachment adjacent the disconnectable coupling means, each said pusher foot comprising a transversely oriented arcuate ground engaging member mounted on a shaft which is received in a holding means therefor mounted on said attachment, and means for retaining said shaft at a selected point along said holding means.

5. A chain digger attachment as claimed in claim 2, wherein the spacing between the sprockets is varied by an internal ram that telescopes the elongate support frame.

6. A chain digger as claimed in claim 3, wherein the guide means comprise sprockets, the spacing between the sprockets being varied by an internal ram that telescopes the elongate support frame.

7. A chain digger as claimed in claim 3, further including means for adjustably mounting said pusher feet to said support frame, adjustment of said feet permitting the depth of said trench to be variably selected.

* * * * *